United States Patent [19]

Rinaldi

[11] Patent Number: 4,676,313

[45] Date of Patent: Jun. 30, 1987

[54] CONTROLLED RESERVOIR PRODUCTION

[76] Inventor: Roger E. Rinaldi, 8435 S. Quebec, Tulsa, Okla. 74137

[21] Appl. No.: 793,129

[22] Filed: Oct. 30, 1985

[51] Int. Cl.[4] ..... E21B 44/00

[52] U.S. Cl. ..... 166/252; 166/250; 166/254; 166/268

[58] Field of Search ..... 166/250, 252, 254, 255, 166/268, 269; 73/151, 152, 155

[56] References Cited

U.S. PATENT DOCUMENTS

| | | | |
|---|---|---|---|
| 3,892,270 | 7/1975 | Lindquist | 166/252 |
| 4,155,403 | 5/1979 | Hurst | 166/250 X |
| 4,222,611 | 9/1980 | Larson et al. | 166/268 X |
| 4,433,727 | 2/1984 | Argabright et al. | 166/252 |
| 4,461,172 | 7/1984 | McKee et al. | 166/250 X |
| 4,558,592 | 12/1985 | Despax | 166/250 X |

*Primary Examiner*—Stephen J. Novosad
*Assistant Examiner*—Thomas J. Odar
*Attorney, Agent, or Firm*—Head Johnson Stevenson

[57] ABSTRACT

This invention contemplates a method of enhancing oil and/or gas recovery by properly drilling injection and production wells into a reservoir, incorporating flow control valves and sensors in both sets of wells, and connecting these valves and sensors to a surface computer. The computer compares the fluid flow data from the valves and sensors to a theoretical flow model of the reservoir to determine actual fluid flow paths in the reservoir. The computer then determines the optimum fluid flow rates and paths and adjusts the valve open-close patterns and settings accordingly, to force the reservoir fluid flows into those paths. The computer continually performs these operations so as to constantly provide maximum sweep efficiency and therefore optimum reservoir productivity. In conjunction with the above methodology, the densities and viscosities of the injected fluids can be varied so that they can assist with the vertical movement of fluids within the reservoir. The method and means described can also be used for leaching or chemical extraction means used in mining or mineral deposit extraction processes.

15 Claims, 9 Drawing Figures

CONTROLLED RESERVOIR PRODUCTION

BACKGROUND OF THE INVENTION

This invention relates to improvements in oil and/or gas well production methods and means and more particularly, but not by way of limitation, to a controlled reservoir production method and means for increasing fluid recovery from a well bore. The method and means described can also be used for leaching or chemical extraction means used in mining or mineral deposit extraction processes.

It is a well known fact that out of the 440 billion barrels of proven oil reserves in the United States only about one-third, or approximately 145 billion barrels, can be produced by normal means. The reason for this low recovery can primarily be attributed to high reservoir capillary forces, high oil viscosity and low reservoir sweep efficiency.

Extensive research has taken place regarding the movement of fluids through subsurface formations or through a medium, and the mechanisms and means required to reduce capillary forces and high oil viscosities. The fluid movement research has concentrated on the ways by which fluids move through various media, the media constraints placed upon the fluids, etc. In the area of capillary forces and high oil viscosities, injection fluids have been developed that can reduce capillary forces and lower high oil viscosities. Despite these efforts and considerable field testing the results of this work have not been very encouraging. Operation efficiencies still remain quite low and the costs quite high. Improving sweep efficiency has been even more difficult to do if one uses conventional well placement techniques. Thus, the means and technology to increase oil recovery from known reservoirs has not significantly improved, nor have the techniques of applying chemical or leaching extraction processes.

SUMMARY OF THE INVENTION

The present invention contemplates a novel method of oil and/or gas recovery that provides the reservoir operator with greatly increased knowledge of the fluid flow within a reservoir, and allows him to adjust or control that movement as he desires so that he can obtain optimum reservoir production. With this means, fluid sweep efficiency can be greatly improved, and thereby enhance the reduction of total capillary forces and/or assist in the lowering of oil viscosity.

The proposed techniques are illustrated in FIGS. 1 and 2. The system consists of a series of injection wells and production wells that are directionally drilled into a reservoir in a predetermined pattern. The pattern, which may or may not place the wells in the same plane, is based upon that configuration which provides low fluid reservoir travel and maximum reservoir coverage. Each well incorporated a series of surface and subsurface valves and sensors that are controlled from the surface. Specific fluids at specified flow rates and pressures enter the injection wells at the surface and are forced into the reservoir via specifically set valve opening patterns. The fluids are then forced by a back pressure to flow toward the production wells. The production wells may also contain a series of valve controlled openings that allow the reservoir fluids to enter. Each of these valves contains a flow measuring device and/or a tracer detection mechanism. These valves and devices or mechanisms are also controlled from the surface.

On the surface, the control wiring or communication means from each of the valves and sensors in the injection and/or production wells is attached to a computer or similar device. This device contains a theoretical model of the reservoir. The model, with input information as to the open or close position of all of the valves, compares and evaluates the actual fluid flow rates and pressures from the injection well valves into the reservoir, and the ensuing reservoir fluid flow rates and pressures into the production well valves, against the theoretical fluid flow rates and pressures computed by the model. This evaluation determines the flow paths of the fluids in the reservoir. The model then defines the best valve open or close pattern and the best fluid flow rates and pressures into the reservoir so that optimum sweep efficiency and thus optimum fluid flow from the reservoir can be obtained. The computer then opens or closes the well valves and adjusts flow rates and pressures accordingly. The computer continually monitors and compares these pressures and flow rates, determines flow patterns, and opens or closes the reservoir valves as required. In this manner, both injected fluids and reservoir fluids are forced to flow in those patterns that produce optimum flow.

The main technical advantage of the defined system is the ability to place sensors and valves in a reservoir, determine how the injected fluids and the reservoir fluids are actually flowing in the reservoir and then by means of opening and closing the valves, physically inject fluids into the reservoir at those positions and at those rates which will force the fluids to flow in those patterns that produce optimum fluid flow. Because of the large volume of data involved and the comparative analysis involved, computer evaluation techniques are required. The main economic advantage of the system is the increased productivity due to the improved sweep efficiency.

Because of the physical structure and comparative abilities of the system, a second capability for enhancing oil and/or gas recovery may be obtained by injecting fluids of different densities and viscosities into the reservoir according to flow rates and volumes, and valve positions determined by the surface computer model. It is a well known fact that fluids of different densities will stratify rapidly and sharply when forced through a medium as illustrated in FIG. 5. This stratification is dependent upon the density of the fluid and less dependent on the fluid viscosity. Considerable work has been done in this area by major corporations and research facilities. However, their work has not incorporated or used the well configurations, and valve and sensor capabilities contemplated by this invention. Thus, if fluids of different densities and viscosities are injected into a reservoir using the valve and sensor system of this invention, it will be possible to move the injected fluids in a vertical manner and thereby assist in improving the reservoir sweep efficiency. It must be understood however, that vertical movement in a reservoir can be constrained depending upon geological stratification.

DETAILED DESCRIPTION OF THE PREFERRED EMBODIMENTS

Figure 1:
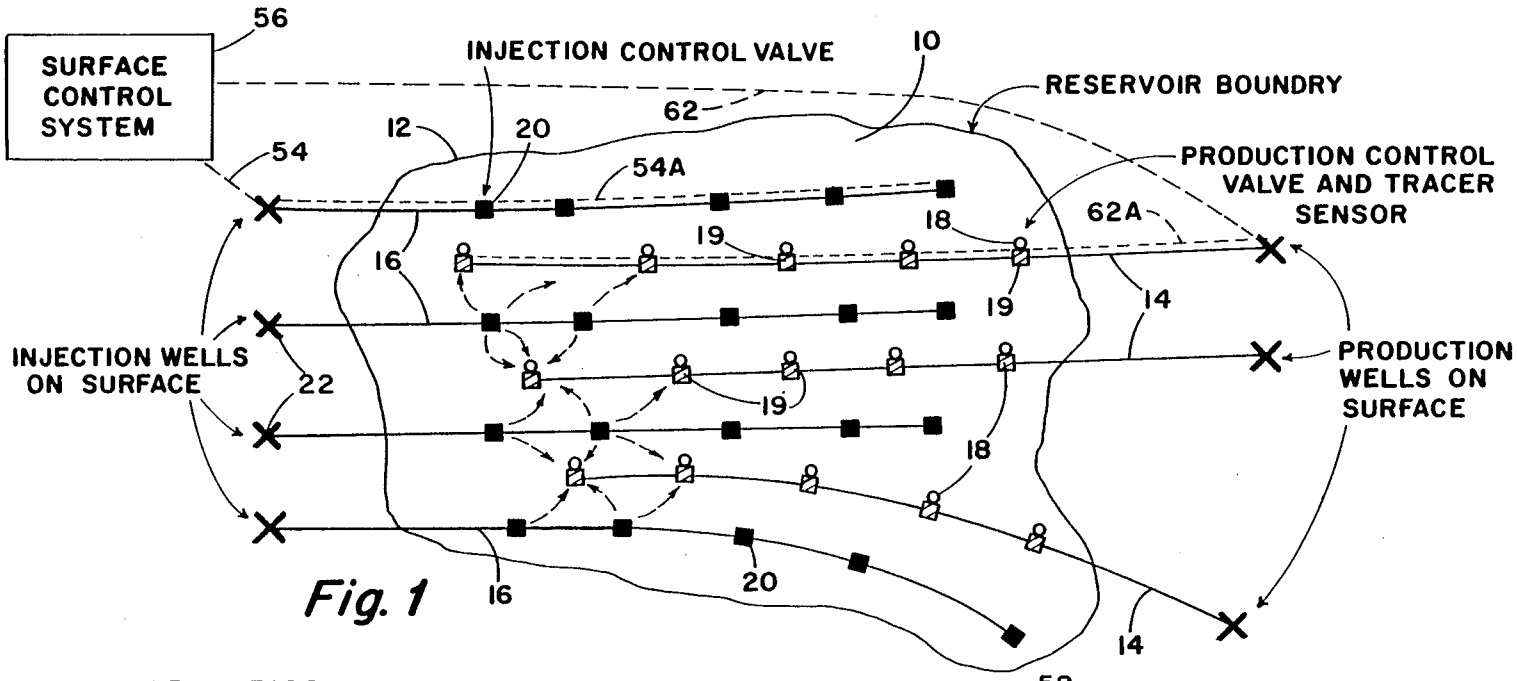
FIG. 1 is a schematic top or plan view of a reservoir and an enchanced oil and/or gas recovery method embodying the invention.

One possible sequence of steps for practicing the present invention may be as follows, and as particularly shown in FIGS. 1 and 2:

1. Select a fluid reservoir 10 to be treated for enhanced oil and/or gas recovery.

2. Determine the reservoir boundary 12 and characteristics of the medium of the reservoir by the usual geological and/or seismic techniques.

3. Using the controlled reservoir production technology, as will be hereinafter set forth, drill a first substantially horizontal production well bore 14 into the reservoir 10.

4. Log and drill stem test this first well bore in the usual manner to obtain additional reservoir data.

5. Concurrent with drilling the wells, construct a computer model that can simulate the actual subsurface fluid reservoir conditions and characteristics, including geological data and structure characteristics, information about the reservoir fluids and the injected fluids, the location of the injection and production wells in the reservoir and the location and operational state of the control valves. The model will be designed in a way that will facilitate the determination of the type, volume and location of the fluids to be injected into the reservoir so as to maximize reservoir productivity.

6. Determine the placement of a first horizontal injection well bore 16 and drill the well bore 16 into the reservoir 10. Log and drill stem test this first injection well bore 16 to obtain still additional data for the model and update the model with any information ascertained by the second log and drill stem testing.

7. Steps 3, 4 and 6 may be repeated until the reservoir 10 is economically and properly drilled with spaced apart production and injection well bores. The horizontal production and injection well bores may be in a common horizontal plane if the reservoir 10 is of relatively shallow height, or the production and injection well bores may be spaced in two or more different horizontal planes.

8. Complete the model in accordance with all of the data or information attained through the log and drill stem testing of the well bores. Consideration of the controlled reservoir production technology may then be made in light of the contents of the model in order to determine the controlled reservoir production needs at the subsurface formation 10.

9. Install in all of the well bores the necessary injection control valves 20, production intake control valves 19, and sensors 18.

At each injection wellhead 22 a valve 50 is employed to control the volume of fluid flow in the well. A meter 52 measures this flow rate. The meter also includes a pressure gauge. Information as to pressure and flow rate is fed by a conductor 54 to the surface control system 56 which contains the computer in which the formation model is stored. A valve 58 and a pressure gauge 60 are in like manner installed at each production wellhead 64. Conductor 62 transmits information from meter and pressure gauges 58 and 60 to the surface control system 56. Conductors 54 and 62 are extended as conductors 54A and 62A, respectively, to the production and injection valves and the bore hole sensors located in the well bores. These conductors are used to control the opening and closing of the bore hole valves and to transmit data to the computer regarding the formation characteristics.

10. Operate the computer model to determine the best production procedure in light of the known reservoir data.

11. Initiate the flow of injection fluids through the injection well heads 22 of the injection well bores. Automatically open and/or close the valves 19 and 20 as prescribed by the computer model. It may be found desirable to use proper or well known injection fluids from the very beginning of a well production operation in a new reservoir 10 to maintain best overall productivity. In partially produced reservoirs the optimum time of use of the injection fluids must be determined.

12. As the reservoir 10 is produced, or as fluid is retrieved from the reservoir 10, the computer will continually compare and evaluate the actual fluid flow rates and pressures from the injection well valves 20 into the reservoir 10 and the ensuing reservoir fluid flow rates and pressure into the production well valves 19, against the theoretical fluid flow rates and pressures computed by the model. This evaluation determines the best valve open or close pattern, the best fluid flow rates and pressures and the best fluid flow paths in the reservoir so that optimum sweep efficiency and, thus, optimum fluid flow from the reservoir can be obtained. The computer then opens or closes the valves in the system accordingly. The computer continually monitors and compares these pressures and flow rates and continually opens or closes the reservoir valves. In this manner both injected fluids and reservoir fluids are forced to flow in those patterns that maintain maximum reservoir productivity.

Figure 2:
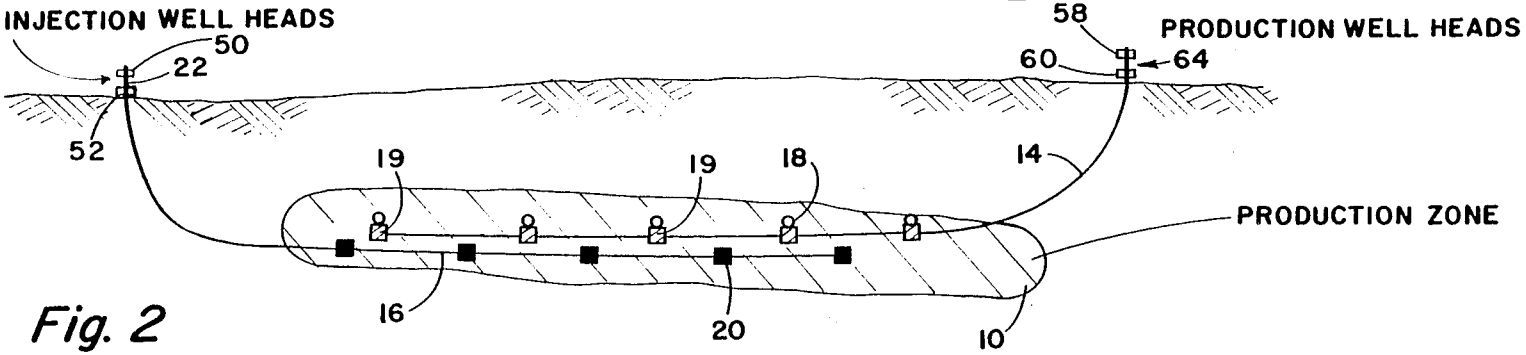
FIG. 2 is a sectional elevation view of the enhanced oil and/or gas recovery method shown in FIG. 1.
Figure 3:
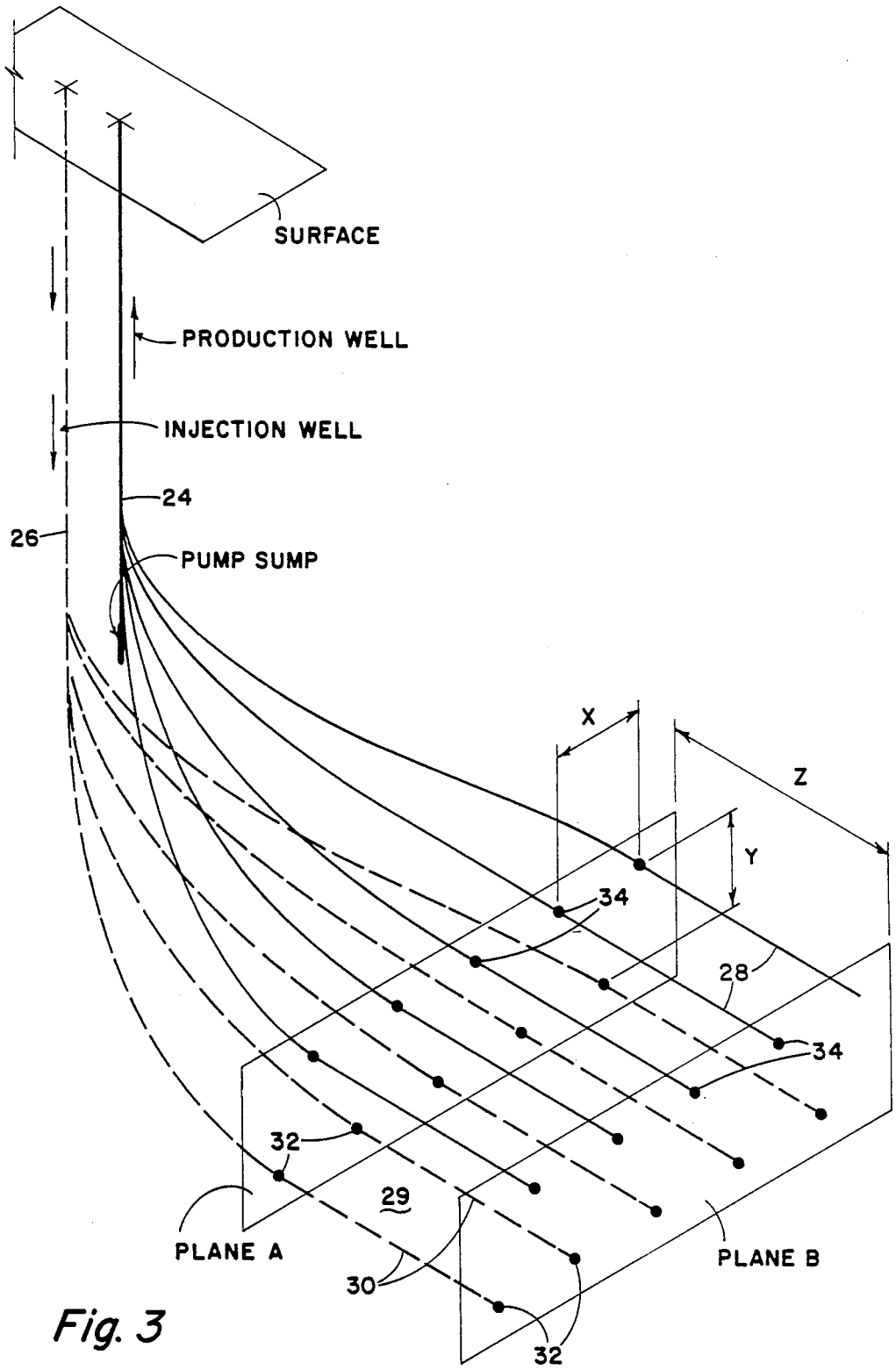
FIG. 3 is a schematic perspective view of a modified enhanced oil and/or gas recovery method embodying the invention.
Figure 5A:
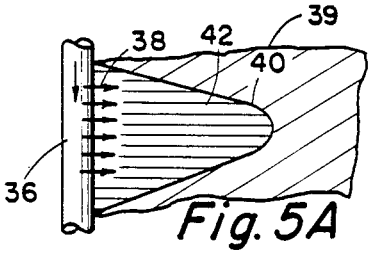
FIG. 5A through 5E are schematic sectional elevation views illustrating the movement of fluids of different densities through a fluid reservoir or medium in an enhanced oil and/or gas recovery method embodying the invention.
Figure 5B:
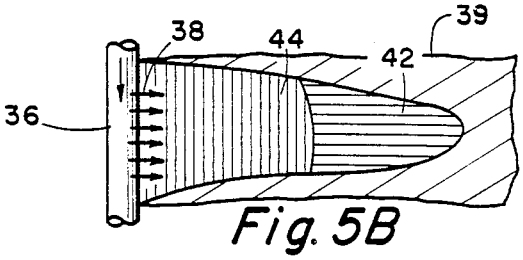
Figure 5C:
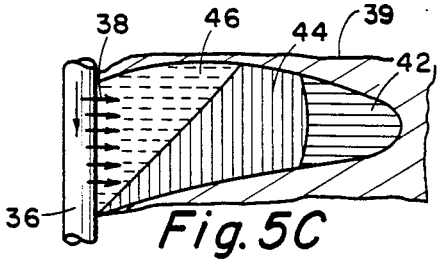
Figure 5D:
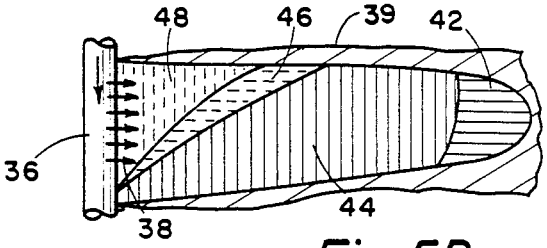
Figure 5E:
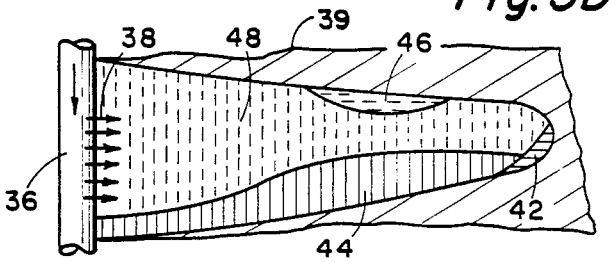
Figure 4:
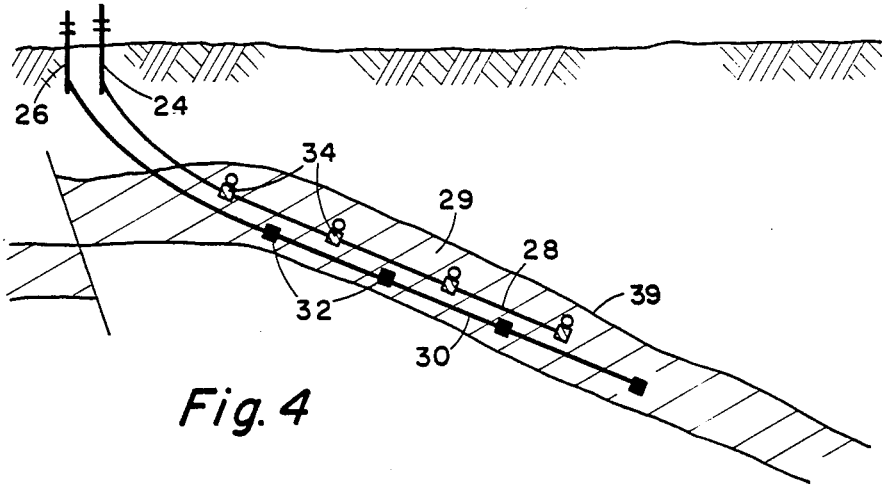
FIG. 4 is a sectional elevation view of the enhanced oil and/or gas recovery method shown in Figure 3 or a sectional view of a tilted reservoir requiring the use of a different type of well pattern.

Whereas a plurality of properly spaced injection well bores 16 and production well bores 14 are shown in FIGS. 1 and 2, it may be preferable to drill a single production well bore 24 in spaced relation to a single injection well bore 26 as shown in FIGS. 3 and 4. A plurality of speed substantially horizontally extending well bores 28 may be extended from the production well 24 into the formation or reservoir 29 bounded by the planes A and B. In addition, a plurality of spaced substantially horizontally extending well bores 30 may be extended from the injection well bore 26 and into the medium or reservoir bounded by the planes A and B. In the particular instance shown in FIG. 3, the injection well bores 30 are disposed at a lower elevation than the production well bores 28, but it is to be understood that the reverse situation may be utilized if desired. That is, the production wells 28 may be placed or situated at a higher elevation than the injection well bores 30. The injection wells 30 may be provided with valves, nozzle or other suitable injection means 32 in the proximity of the planes A and B or within the medium contained therebetween whereby the injection fluid or fluids may be introduced into the formation. The production wells 28 may be provided with suitable intake means or valve means 34 disposed in the proximity of the planes A and B or in the medium therebetween for retrieval of the fluid therefrom as is well known. The spacing X and Z between the nozzle means 32 and/or valve means 34 as well as the spacing Z between the planes A and B may be selected at the desired optimum dimension therefor. The control mechanisms, wiring systems, computer models, etc., previously described are also incorporated in this system.

Referring now to FIGS. 5A through 5E, assume that an injection well 36 is suitably perforated 38 or otherwise constructed for injecting fluid or fluids 42 into a substrate or medium 39. Assume fluid 42 has a high density and low viscosity. Fluid 42 will flow into substrata 29 in a pattern similar to 40. A second fluid 44, similar in density to fluid 42, is injected behind fluid 42 into strata 39. The flow pattern will be similar to that noted in FIG. 5B. Assume a third fluid 46 of lighter density than fluids 42 and 44 is injected behind fluid 44. Fluid 46 will tend to flow up and over fluid 44 because because of the difference in their densities. If a medium density fluid 48 is now injected in the strata, it will tend to flow between fluids 44 and 46 as noted in FIG. 5D and 5E.

The fluid movement or drive systems illustrated in FIGS. 5A through 5E can be utilized in the controlled reservoir production of the present invention to assist in maneuvering or forcing the movement of the fluids in a medium or reservoir substantially as desired. It is to be noted that the lighter fluids will rise up and over heavier fluids, and more interestingly it is noted that the medium weight fluids will force themselves between fluids that are lighter and heavier. When combining these facts with the knowledge of reservoir geological characteristics, improved directional control of water flood operations, micellar programs, $CO^2$ operations and the like may be possible with the benefit being a greater sweep efficiency and thus higher oil and/or gas production. Of course, viscosity, temperature and pressure characteristics must obviously be considered.

The fluid movement characteristics are also of value when utilizing the multi-hole well bore pattern as shown in FIGS. 1 and 3. In the embodiment shown in FIG. 3, the oil bearing fluids contained within the subsurface formation 29 may be forced either upwardly or downwardly, as desired, dependent upon the density of the fluids used in the process. For example, if the lower set of wells 30 are utilized for the injection wells, then high density fluids should be injected first. A second set of lower density scavaging fluid may then be injected. These lighter fluids will tend to flow up and over the heavier fluids, to the higher set of production wells 28.

The methods of this invention are useful in extracting minerals from the earth, in which the term "minerals" include petroleum as well as minerals which normally exist in a solid state, such as sulphur, copper, etc. which can be leached using the techniques described herein.

While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalence to which each element thereof is entitled.

I claim:

1. A method for extracting a mineral from an earth formation comprising:

determining the formation boundary and characteristics;

establishing in a computr a model of the formation;

drilling at least one production well bore into the formation spaced from said production well;

drilling at least one injection well bore into the formation;

obtaining additional formation characteristics by use of the well bores;

updating the computer model using the formation characteristics obtained from the (boreholes) well bores;

installing spaced control valves in the injection and production well bores, which valves are controlled between open and closed conditions in response to information supplied by the computer in accordance with the model of the formation stored therein;

introducing injection fluid into said at least one injection well bore;

removing produced fluid from said at least one production well bore;

continuing to update the computer model in response to detected formation characteristics; and operating said control valves in response to the computer model to control the flow paths of fluid movement through the formation.

2. A method for extracting a mineral according to claim 1 including:

installing sensors in at least one of said injection well bores and production well bores, the sensors being connected to provide formation characteristic updates to said computer.

3. A method for extracting a mineral according to claim 1 including the step of:

measuring the fluid flow rates and pressures at said at least one injection wells and production wells; and updating said computer with such measured fluid flow rates and pressures.

4. A method for extracting a mineral according to claim 1 including the steps of:

injecting at different time and in different volumes injection fluids having different densities and viscosities to control the movement of injection fluid through the formation.

5. A method for extracting a mineral according to claim 1 wherein the mineral is leached from the formation by fluid injected into said injection well.

6. A method for extracting a mineral according to claim 1 wherein the mineral is oil or gas.

7. A method for extracting a mineral from an earth formation comprising:

determining the formation boundary and characteristics;

establishing in a computer a model of the formation;

drilling a plurality of spaced apart production well bores into the formation;

drilling a plurality of spaced apart injection well bores into the formation, said injection well bores being at least in part interleaved with and spaced from said production well bores;

obtaining additional formation characteristics by use of the well bores;

updating the computer model using the formation characteristics obtained from the boreholes;

installing spaced control valves in the injection and production well bores, which valves are controlled between open and closed conditions in response to information supplied by the computer in accordance with the model of the formation stored therein;

introducing injection fluid into said injection well bores;

removing produced fluid from said production well bores;

continuing to update the computer model in response to detected formation characteristics; and operating said control valves in response to the computer model to control the flow patterns of fluid movement through the formation.

8. A method for extracting a mineral according to claim 7 including:

installing sensors in said injection well bores and production well bores, the sensors being connected to provide formation characteristic updates to said computer.

9. A method for extracting a mineral according to claim 7 including the step of:

measuring the fluid flow rates and pressures at said injection well bore and production well bores; and updating said computer with such measured fluid flow rates and pressures.

10. A method for extracting a mineral according to claim 7 including the steps of:

injecting at different time and in different volumes injection fluids having different densities and viscosities to control the sweep of injection fluid through the formation.

11. A method for extracting a mineral according to claim 7 wherein the mineral is leached from the formation by fluid injection into said injection well bores.

12. A method for extracting a mineral according to claim 7 wherein the mineral is oil or gas.

13. A method according to claim 7 wherein at least a substantial portion of said plurality of injection and production well bores within the formation boundry are substantially horizontal.

14. A method according to claim 13 wherein said substantially horizontal portions of said production and injection well bores are in substantially a common horizontal plane.

15. A method according to claim 13 wherein said substantially horizontal portions of said production well bores are in a substantially horizontal plane and wherein said substantially horizontal portions of said injection well bores are in a substantially horizontal plane, and wherein said horizontal planes are at a different elevation.

* * * * *